US010994565B2

(12) United States Patent
Carmichael

(10) Patent No.: US 10,994,565 B2
(45) Date of Patent: May 4, 2021

(54) LIQUID-BEARING ARTICLES FOR TRANSFERRING AND APPLYING LIQUIDS

(71) Applicant: Sandon Global Engraving Technology Limited, Runcorn (GB)

(72) Inventor: Gary Carmichael, Runcorn (GB)

(73) Assignee: SANDON GLOBAL ENGRAVING TECHNOLOGY LIMITED, Runcorn (GB)

( * ) Notice: Subject to any disclaimer, the term of this patent is extended or adjusted under 35 U.S.C. 154(b) by 300 days.

(21) Appl. No.: 16/071,373

(22) PCT Filed: Jan. 26, 2017

(86) PCT No.: PCT/EP2017/051640
§ 371 (c)(1),
(2) Date: Jul. 19, 2018

(87) PCT Pub. No.: WO2017/129677
PCT Pub. Date: Aug. 3, 2017

(65) Prior Publication Data

US 2018/0319195 A1 Nov. 8, 2018

(30) Foreign Application Priority Data

Jan. 26, 2016 (GB) ..... 1601459

(51) Int. Cl.
*B41N 7/06* (2006.01)
*B41C 1/05* (2006.01)
(Continued)

(52) U.S. Cl.
CPC ..... *B41N 7/06* (2013.01); *B41C 1/05* (2013.01); *B41N 1/006* (2013.01); *B41N 1/06* (2013.01); *B41N 7/04* (2013.01); *B41C 1/18* (2013.01)

(58) Field of Classification Search
CPC . B41N 7/06; B41N 1/006; B41N 1/06; B41N 7/04; B41C 1/05; B41C 1/18
See application file for complete search history.

(56) References Cited

U.S. PATENT DOCUMENTS 4,819,558 A 4/1989 Counard
5,033,377 A * 7/1991 Shimizu ..... G03F 5/20 101/150

(Continued)

FOREIGN PATENT DOCUMENTS

EP 1034905 A2 9/2000

OTHER PUBLICATIONS

International Search Report in PCT/EP2017/051640, dated May 3, 2017.

(Continued)

*Primary Examiner* — David H Banh
(74) *Attorney, Agent, or Firm* — John H. Choi & Associates LLC

(57) ABSTRACT

An article with an operative liquid-bearing surface is adapted for transferring that liquid to a substrate material or printing plate. The entire operative surface of the article is provided with a pattern of microscopic discrete depressions which are usually laser-engraved into the surface so that a substantially continuous wall structure remains which surrounds and defines the depressions. In particular the depressions are of a cross-sectional shape which is symmetrical about one or both of a lateral and a medial axis perpendicular thereto, and arranged adjacent one another in offset fashion, and above and below one another so that the pattern thus formed is substantially uniform and repeating. Each of at least one of the pairs of lateral or medial sidewalls of any one depression are contoured, the contour of one of the pair being generally the mirror image of the other.

30 Claims, 8 Drawing Sheets

(51) Int. Cl.

| | |
|---|---|
| ***B41N 1/00*** | (2006.01) |
| ***B41N 7/04*** | (2006.01) |
| ***B41N 1/06*** | (2006.01) |
| *B41C 1/18* | (2006.01) |

(56) References Cited

U.S. PATENT DOCUMENTS

| | | | | |
|---|---|---|---|---|
| 6,701,839 | B1 * | 3/2004 | Levy | B41F 9/00 101/153 |
| 2002/0001727 | A1 * | 1/2002 | Robbins | B05D 7/14 428/450 |
| 2005/0208275 | A1 * | 9/2005 | Abe | B32B 27/20 428/195.1 |
| 2007/0107611 | A1 * | 5/2007 | Takashima | B41F 9/00 101/153 |
| 2015/0107472 | A1 | 4/2015 | Yoshida | |
| 2015/0107473 | A1 * | 4/2015 | Yoshida | B41N 1/20 101/395 |

OTHER PUBLICATIONS

Written Opinion in PCT/EP2017/051640, dated May 3, 2017.
Notification of Transmittal of the International Preliminary Report on Patentability in PCT/EP2017/051640, dated May 14, 2018.

* cited by examiner

LIQUID-BEARING ARTICLES FOR TRANSFERRING AND APPLYING LIQUIDS

CROSS-REFERENCE TO RELATED APPLICATION

This application claims priority to PCT Application No. PCT/EP2017/051640, filed on Jan. 26, 2017, which claims priority to GB 1601459.9, filed Jan. 26, 2016, each of which is incorporated by reference in its entirety.

FIELD OF THE INVENTION

The present invention relates to commonly liquid-receiving and liquid-bearing articles which are adapted for transferring and/or applying liquids, most commonly printing inks, lacquers, varnishes, adhesives and the like, to substrates such as paper, board and plastics films typically provided in sheet form, and in some cases, other liquid-receiving components such as print cylinders and plates. More specifically the present invention relates to articles such as rolls, mandrel- or arbor-mounted sleeves, plates and the like, the operative liquid-bearing surfaces of which are engraved, embossed, incised, etched or otherwise processed so that a generally uniform and substantially repeating pattern of cells (and the corresponding cell walls which define them), or continuous or discontinuous channels (and the lands in between them, commonly known as a "pin-up" configuration), is provided over substantially the entire operative surface of the article. In use, a liquid applied to the operative surface of such an article is retained thereon prior to coming into contact with either a printing plate or the substrate material, whereby the liquid is transferred, either directly or indirectly (as in offset techniques) to the substrate uniformly, and in a consistent and repeatable manner.

Although the following description is provided with almost exclusive reference to the print industry, and specifically to the laser-engraved ceramic-coated sleeves, rolls or plates which are provided within typically web-fed rotary (or sheet-fed reciprocating) print machinery, the present invention should not be considered as being limited by any particular application. Furthermore, although modern laser engraving techniques lend themselves most usefully to the patterned engraving of ceramic-coated rolls, sleeves and the like, particularly those commonly described as "Anilox/Gravure" in the print industry, processes other than laser engraving could equally be employed, and the articles may be coated with compositions other than ceramics. It is also possible that the articles may be uncoated or of laminar construction, provided that their outermost surface is capable of being engraved, embossed, etched or incised so that a pattern of varying relief is provided thereon.

BACKGROUND TO THE INVENTION

Anilox/Gravure rolls are used in print machinery for applying a measured amount of a liquid printing ink, varnish, lacquer or in some cases, an adhesive to a substrate material typically either in sheet form or on a reel, and as such, they are one of the most important components of such machinery as it is the Anilox/Gravure rolls which fundamentally dictates both the quantity of liquid applied to the substrate material and the uniformity of that application. Most commonly the Anilox/Gravure roll is of a steel or aluminum construction, in some cases taking the form of a sleeve, the outer cylindrical surface of which is coated with a layer of an industrial ceramic (Chromium(III) oxide, $Cr_2O_3$, being most common, but other Oxides, Carbides, and Tungsten and Molybdenum-based coatings are also known) by one of a variety of application techniques, such as plasma application, flame-spraying, chemical deposition, and application by electrolysis. The ceramic coating is then laser-engraved so as to provide a substantially uniform pattern of microscopic cells, depressions or channels therein. The manner in which the Anilox/Gravure roll is coated with a layer of a print liquid is not relevant to this Application, except to mention that the aim of the known liquid transfer mechanisms (e.g. ink fountains, chamber doctor blade systems, metering rollers, doctor blades and the like) is to ensure that the liquid is applied to the Anilox/Gravure roll in an even and repeatable fashion every time it rotates or reciprocates. In any event, it is the manner in which the liquid is retained on the Anilox/Gravure roll after application thereto, and the manner in which it is released therefrom, which ultimately determine both the evenness of the liquid coating ultimately transferred to the substrate, and the thickness (commonly referred to as dry coat or film weight) of that coating.

As such, it is understood that the cell pattern, dictated by the shape configuration of each individual cell within that pattern, the depth of the cells and the resulting volume (usually expressed as $cm^3/m^2$ or $BCM/in^2$), are all crucial factors in determining the efficacy of the Anilox/Gravure roll, and in turn the overall quality and characteristics of the printed substrate material. Indeed it has been proposed that the particular cell shapes and their corresponding patterns can, at least to some extent, be custom-tailored for particular printing techniques and applications, for different printing inks and other liquids, and also for the particular substrate materials to be printed. For example, different cell shapes and patterns have been proposed for

- gravure or flexographic printing, metal decoration and laminating applications,
- applications requiring particularly high or low dry coat weights, or different opacities,
- applications requiring high or low definition, resolution or precision of images and other content printed on the substrate material,
- different substrates, for example paper, board and card, or plastics, particularly polymer plastics films,
- ultra-violet (UV) cured inks, varnishes and lacquers, dry- or heat-cured liquids, including adhesives.

Specific examples of engravings available from the Applicant herefor include the HVS (High Volume Solids), i-Pro, HOW (high opacity white), and HVP (High Volume Process) engravings.

Despite the number and variety of cell shapes, dimensions, depths, and their corresponding cell patterns, there are a number of problems commonly encountered when printing or coating with Anilox/Gravure and other rolls with laser-engraved cell patterns. Such problems are manifested firstly in terms of the quality of the printed substrate material, on which issues such as pin-holing, haze, moiré effects and absorption can arise, such generally being the direct result of an uneven transfer of print or coating liquid from the engraved roll. Secondly, in terms of the Anilox/Gravure roll itself, the most common problem is blocking, particularly where cells are relatively deep and a residue of print or coating liquid remains in the lower reaches of the cell after each transfer, eventually solidifying therein and effectively completely compromising the transfer characteristics of the roll.

As performance demands for Anilox/Gravure and other rolls are increasing, particularly with regard to operative speeds, it is becoming increasingly difficult to ensure that each and every cell of the engraving contains exactly the same amount of the printing liquid after it is applied to the surface of the Anilox/Gravure roll. The viscosity and surface tension characteristics are different for every liquid, and these affect the extent to which the liquid can flow over the surface of the Anilox/Gravure roll and the extent to which it is retained and contained within any one cell. Such factors also importantly affect the liquid transfer characteristics of the Anilox/Gravure roll, that is the extent to which the liquid content of any one cell within the engraving on the Anilox/Gravure roll is transferred either to the substrate material or (more commonly) to an offset print cylinder or plate. In practice, it is simply impossible to achieve either a perfectly uniform liquid distribution over the entire surface of the Anilox/Gravure roll. Furthermore, it is also proving impossible to achieve complete transfer of the entire volume of liquid in each and every cell to the substrate or the offset print cylinder.

The present invention therefore has as one of its objectives the provision of an engraved, embossed, etched or incised liquid bearing article which seeks to improve both the uniformity of liquid retention on that article, and the extent to which the liquid borne by the article is subsequently transferred either to a substrate material or an offset or transfer roll or plate.

It is a further object of the invention, in some embodiments, to provide an article on a liquid-bearing surface of which is provided a generally uniform repeating pattern of individual cells being of a relatively shallow depth to mitigate against blocking, but which have a relatively large cross-sectional shape so that the volume of print or coating liquid contained within each cell (and thus by the entire liquid-bearing surface of the article) is sufficient to meet modern demands for high coat weights without compromising, and in some cases actually improving, the transfer characteristics of the article.

SUMMARY OF THE INVENTION

According to the present invention there is provided an article, at least one surface of which is operative in that it is provided with a plurality of microscopic discrete depressions which, in use, are repeatedly filled with a volume of liquid which is subsequently transferred as a result of contact with another article, said depressions being defined around their peripheries by a substantially or predominantly continuous wall structure comprised of the material of which the article surface is constituted, of a cross-sectional shape which is symmetrical about one or both of a lateral and a medial axis perpendicular thereto or is of a cross-sectional shape which can be sheared about its mid-point to give such a shape, those portions of the continuous wall structure defining the depression and being disposed on either side of such axes being the medial and lateral side walls of the depression respectively, arranged adjacent one another to form a substantially uniform pattern of depressions over the operative surface of the article, characterized in that each of at least one of the pairs of lateral or medial sidewalls are contoured, the contour of one of the pair being generally the mirror image of the other so that together, said sidewalls define at least one constriction internally of the depression where each of the sidewalls in that pair is most proximate to the other, and at least two adjacent depression portions having a maximum lateral or medial dimension greater than the lateral or medial dimension of the constriction, said portions being defined on either side of said constriction such that fluid flow from one portion to the other is partially restricted by said constriction.

Thus by contouring either or both pairs of the lateral and medial sidewalls in this fashion, the depression cross-sectional shape is provided with at least one inwardly waisted region which defines the constriction so as to effectively partition the depression into two discrete portions which are in fluid communication with one another, and hereinafter, the term "inwardly waisted" and other cognate expressions shall be construed accordingly. By partitioning the depression in this manner, the fluid retention characteristics of the depression as a whole are markedly improved. Also the fact that each of the contoured sidewalls in pair of lateral or medial sidewalls allows for a generally uniform pattern of depressions to be created over the surface of the article. Again, the uniformity of such pattern improves the overall liquid transfer characteristics of the article as a whole.

Preferably, the depression portions are of at least similar if not (most preferably) identical shape.

Preferably the pattern is such that a first of any adjacent pair of depressions is at least partially offset from a second relative to one or both of the lateral or medial axis of the first depression so that not only are each of the depressions in that pair at least partially peripherally defined by a portion of the continuous wall structure which they share, but that also a third depression disposed adjacent both of said first and second depressions is at least partially peripherally defined by and further portions of the continuous wall structure shared with each of said first and second depressions.

Preferably the cross-sectional shape of the depression is symmetrical about both the lateral and medial axes, rotated or sheared as they may be.

Most preferably, the inward waisting of the lateral or medial sidewalls of the depression is provided substantially at the mid-point of those sidewalls.

Preferably, one of the pair of lateral or medial sidewalls of each depression in the pattern is straight, and most preferably parallel to one another, and ideally also parallel to either the lateral or medial axis defined for any one particular depression.

Preferably, the maximum lateral or medial dimension of the depression portions is equal to (1+x) times the length of one of the pair of respective medial or lateral sidewalls which partially define them, where x is between 0.25 and 0.75. Most preferably the lateral or medial dimension of the constriction is equal to the length of one of the respective medial or lateral sidewalls.

Thus, above and below the inwardly waisted region of the depression whereat the constriction is formed, the depression can be considered to possess two correspondingly outwardly waisted regions above and below the constriction.

Most preferably, the sidewalls of the depression are contoured in such a manner so as to be complementary in that adjacent but laterally or medially offset depressions within the pattern interlock to at least some degree. For example, one of the outwardly waisted portions of one of the contoured sidewalls of one depression is complementary to the inwardly waisted portion of the contoured sidewall of the adjacent depression in the pattern so that said adjacent depressions can be seen as interlocking with one another along the portion of the continuous wall structure they share.

This interlocking or complementary configuration of depressions in the overall pattern applied to the article is particularly advantageous because it allows for the continuous wall structure provided in the operative surface of the article and which effectively defines all the depressions therein to be of a uniform thickness throughout the entire operative surface of the article, and therefore the overall pattern is uniform, and liquid transfer characteristics of the article are thus optimized.

Preferably, the effective length (i.e. not the actual length measured along the locus of contour) of the lateral sidewalls of any depression, measured along the respective medial axis for that depression, is the same as the width of the medial sidewalls measured along the lateral axis.

Preferably, the article is coated with a layer of a ceramic compound, said ceramic layer provide the operative, liquid-receiving surface of the article.

Preferably, the depressions are shallower (or in preferred alternative embodiments, deeper) than the thickness of the ceramic layer so as to be, together with the substantially continuous wall structure, entirely formed in said ceramic layer.

Most preferably, the article is of cylindrical or annular cross-sectional shape. For example, the article is a sleeve adapted for mounting on a mandrel or arbor.

Preferably the article is a print or coating cylinder or sleeve adapted, in use, to receive printing or coating liquids.

Most preferably, the depressions are formed in the operative surface of the article by means such as engraving, most preferably by thermal optic laser, etching, or any other essentially destructive process whereby microscopic quantities of the material of the initially smooth operative surface of the article, most commonly a ceramic coating applied to the article by plasma- or flame-spraying, are destroyed or removed as part of that process, the depressions being formed in the locations where said material is destroyed or removed, the remaining intervening material forming the substantially continuous wall structure which peripherally defines each and every depression so created.

In a further aspects of the present invention, there is provided a bitmap or other computerized template defining the pattern described above and which, when processed by computer-controlled laser engraving apparatus, results in the application of that pattern to the operative surface of an article provided with a coating from which material is destroyed and, in some cases, also deformed, by the laser.

In a yet further aspect of the present invention, there is provided a computer-controlled method of creating a an article having a liquid-bearing operative surface in which is provided a laser-engraved pattern of substantially identical depressions uniformly arranged over said operative surface and defined by an intervening and substantially continuous wall structure, said method including the steps of:

- providing, in said computer, a template definition of a single depression shape having the characteristics described above,
- providing one or more geometric or other functional relationships between the dimensions of various aspects of that depression shape,
- inputting one or more operating parameters and/or desired functional requirements of the resulting laser-engraved article, such including one or more of wall thickness, line count, depression depth, overall volume requirement (equating broadly to a desired coat weight), an indication of the print or coating liquid, its viscosity and/or its surface tension,
- creating a pattern template based on all the above, and
- using the pattern template so created to control a laser so that the pattern is essentially engraved onto the operative surface of the article.

Various advantages and other aspects of the present invention will become apparent from the following specific description, provided by way of example and with reference to the accompanying drawings wherein:

DETAILED DESCRIPTION

Figure 1:
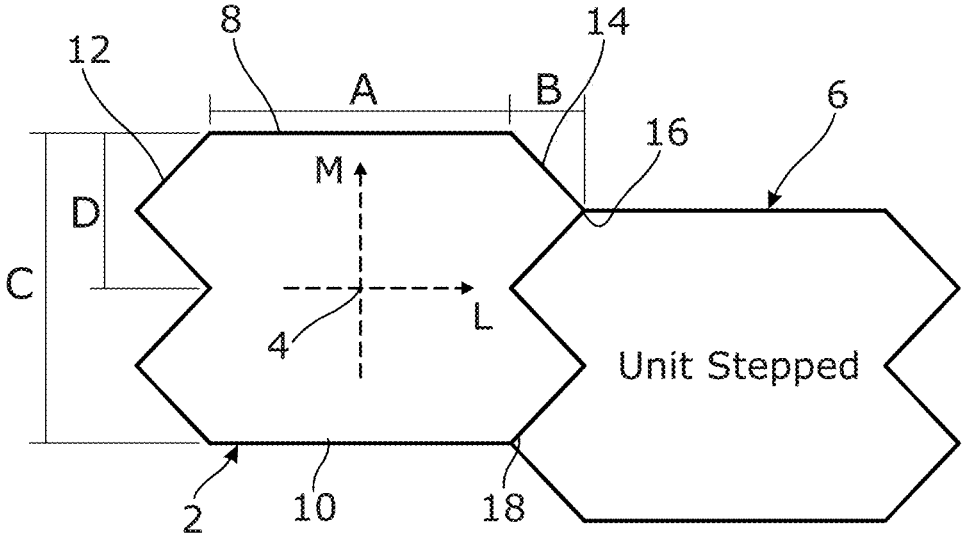
FIG. 1 shows a schematic plan view of two adjacent cells or depressions having inwardly and outwardly waisted lateral sides in offset and interlocking relationship, together with key dimensional indicators for one of said cells or depressions.

Referring firstly to FIG. 1, there is shown schematically a first cell or depression 2 (these terms being interchangeable herein, except where context clearly indicates otherwise) having a mid-point 4 from which extend notional medial (M) and lateral (L) axes respectively, shown by dotted lines, and being hereinafter referred to as the medial and lateral axes of the cross-sectional shape of the depression and in turn prescribing the medial and lateral sidewalls 8, 10 and 12, 14 respectively of the depression. Adjacent the first depression 2 is a second depression 6 of identical shape to depression 2 and medially downwardly offset with respect to the first depression so as to appear in quasi-interlocking relationship with the first depression. It is important to note from this schematic Figure that along their mutually interlocking wall boundaries, in particular between 16 and 18, depressions 2, 6 share a common wall, and that this shared common wall is of the same thickness as other portions of the walls. Also within FIG. 1, there are shown various dimensional indicators A, B, C, D, wherein A represents the length of the medial sidewalls 8, 10, B represents the extent to which lateral sidewalls 12, 14 are outwardly and inwardly waisted (in the embodiment depicted, equally so) in a direction parallel with the lateral axis, C represents the effective length of the lateral sidewalls, as measured between the medial sidewalls, and D represents the effective length of the first outwardly waisted portion of the lateral sidewalls, the effective length of the other outwardly waisted portion of the lateral sidewalls being equal simply to (C-D).

As previously discussed, the term "waisted" and other similar expressions used herein is intended to signify a waist region, most commonly provided in the lateral sidewalls of the depression, but possibly alternately or additionally provided in the medial sidewalls. The waist region may bow inwardly as in the manner of an hourglass (thus "inwardly waisted"). The reader will understand that the depressions which are the subject of this application are of course three-dimensional as they are engraved on the surface of an article, typically an Anilox/Gravure print or coating roll, and may have a depth ranging anywhere from 1 μm-400 μm, and the effective lateral and medial sidewall lengths may range anywhere from 2-5 μm up to 400 μm or possibly greater. It is therefore theoretically possible, given the diameter of the external operative (usually ceramic-coated) surface of any roll to be engraved, and the length of that roll, and possibly also the liquid viscosity and surface tension characteristics, to calculate the theoretical maximum volume of a particular liquid which the roll can receive and carry after a single application. It is also possible to perform this calculation in reverse, so that for a given roll length and diameter, and a desired volumetric capacity, particular cell dimensions and a pattern density thereof can also be calculated.

In embodiments, the following geometric relationships are maintained for this particular shape of depression:

$$A=C$$

$$B=1/4\times A$$

$$D=1/2\times C$$

This provides a depression shape which is symmetrical about both the lateral and medial axes, and is particularly advantageous because it permits a highly uniform pattern to depressions to be achieved, as will later become apparent. Although the particular equality relationship between A and C is useful for some embodiments, it should be mentioned that the relationships can be made more "dynamic" by varying A and C independently of one another without any loss of symmetry or pattern-forming suitability. Indeed, it is exactly by varying A and C in this manner that patterns of depressions with different screen angles can be created (see below).

Figure 1A:
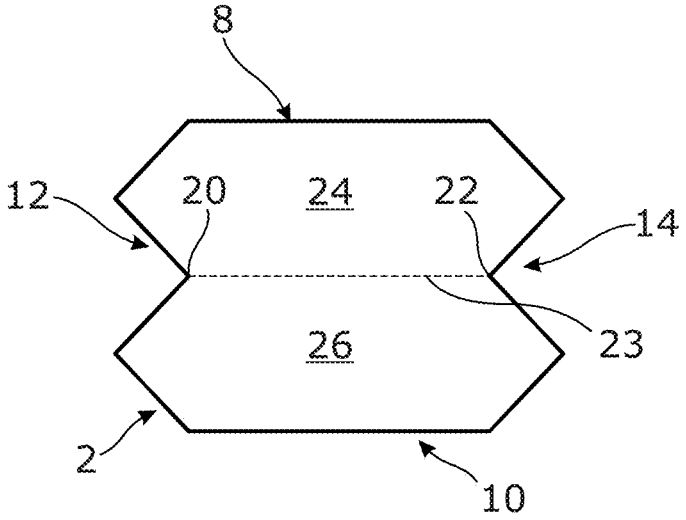
FIG. 1A shows a schematic plan view of one of the first cell or depressions of FIG. 1.

Referring now to FIG. 1A, depression 2 is shown in greater detail and it can be seen from this Figure that effectively, by virtue the inward waisting of lateral sides 12, 14, in particular at 20, 22, the overall shape of the depression is effectively divided along the lateral axis of symmetry (indicated by dotted line 23) into two separate portions 24, 26 being essentially upper and lower halves of the entire depression shape. The inwardly waisting of lateral sides 12, 14 effectively creates a constriction within the depression between the upper and lower halves of the depression such that any fluid present in the upper half 24 is at least to some extent, slightly restricted from flowing freely into the lower half 26 and vice-versa. It is believe that this is one possible reason that an engraved pattern of depressions each of which has this particular shape can perform as well as some of the very open engravings currently available and which are specifically designed for applying very high coat weights, examples including the "pin-up" variety such as HVSTM or linear and helical engravings, such as the Tri-Helical, both available from the Applicant herefor. In addition to the capabilities of carrying significant volumes of print or coating liquid, a further advantage of the present invention is that the depression shape described herein is closed (pin-up and helical engravings are not closed structures), and this means that it is very easy to perform a laboratory test of the volumetric capacity of an engraved roll because a test volume of liquid applied to a test area surface of an engraved roll is retained in the essentially closed depressions engraved in that test area. With open-structure engraving, any test liquid is not so constrained and immediately, as an liquid has a tendency to do, flows away along the channels and pathways defined in the open structure.

A final point on FIG. 1A should also be made. Although the shape of the depression is effectively divided into two halves 24, 26 by the constriction, these two halves are nevertheless in fluid communication with one another, so liquid in one half is not completely restricted from flowing into the other, and also, depending on circumstances, the volume of liquid contained at any time in the entire depression may be act as a single body of liquid. It is believed that the shape of the depression provides some additional structural benefit for the entire body of liquid within it, and that this allows for rolls engraved with a pattern of depressions of this shape to rotate at the high speeds being required in modern printing presses (e.g. upward of 400-600 m/min) without suffering the common problems associated with such high speed operation.

Figure 2:
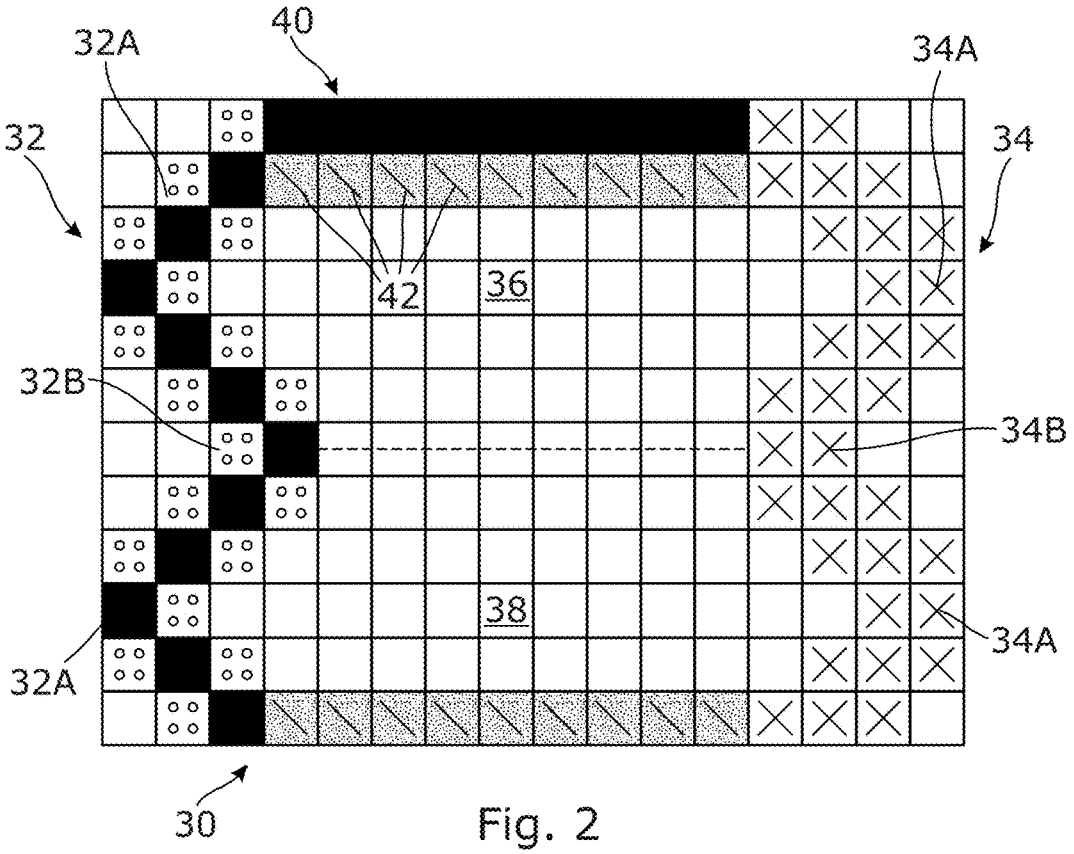
FIG. 2 shows a computer bitmap representation of the shape of a single cell or depression.

Turning now to FIG. 2, a computerized bitmap representation 30 of a single depression is shown. From this Figure, it can be seen that the bitmap representation is very different from the schematic theoretical depression shape of FIGS. 1 and 1A, because as the skilled reader will appreciate, it is impossible to engrave the depression shape of FIGS. 1 and 1A with such precision. However, it can still be clearly seen that lateral sides 32, 34 of the depression shape are still both outwardly and inwardly waisted, at 32A, 34A and 32B, 34B respectively, and that the depression shape is thus effectively divided into two halves 36, 38. It should of course be understood that either the lateral or medial sidewalls of a depression shape may be inwardly waisted at more than one position along the length of said sidewalls, and therefore it is equally possible to provide a depression shape which is divided into more than 2, e.g. 3, 4, or maybe even 5, distinct partially separate portions.

Figure 3:
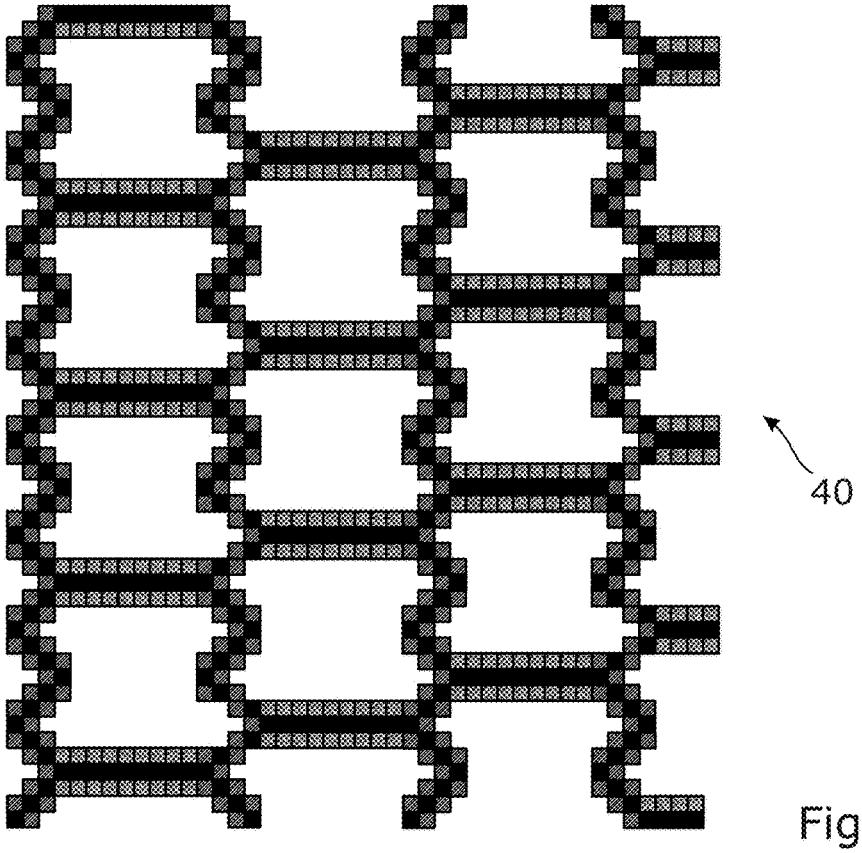
FIGS. 3 and 3A show collections of the computer bitmaps of FIG. 2 arranged adjacent and atop one another so as to produce a bitmap pattern of the type which would be used by computer-controlled laser engraving apparatus to engrave the surface of an article.
Figure 3A:
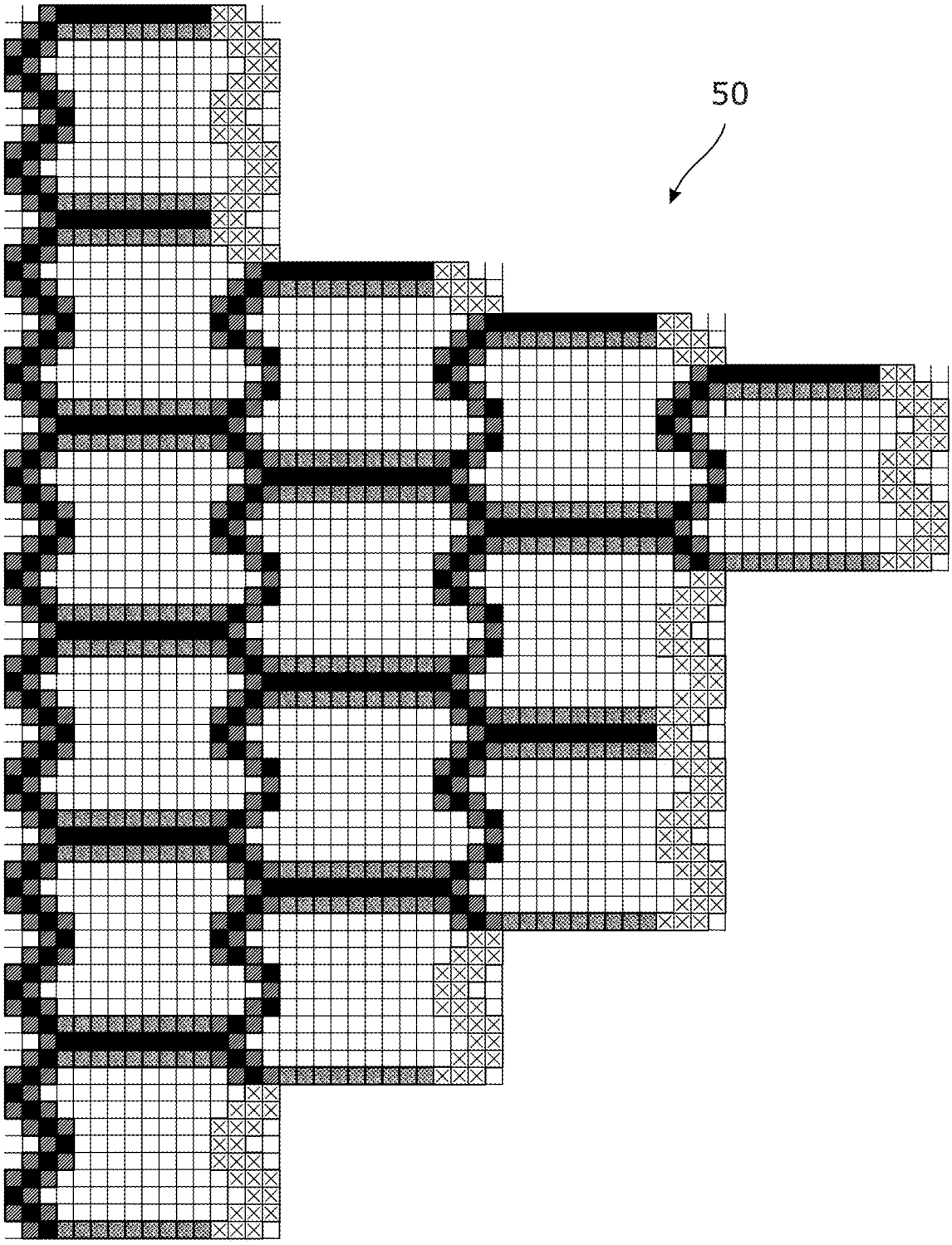

What is important to note in FIG. 2 is that the bitmap 30 includes differently colored or hatched pixels, and also that the bitmap is not symmetrical, at least about the lateral axis. As regards the first of these points, as part of the process of laser engraving, it is possible not only to adjust the special position of the high energy laser beams which destroy, for example by melting and subsequently burning away, the ceramic material where they come into contact with it, but it is also possible (and simultaneously) to adjust the energy or intensity thereof. In the context of FIG. 2 therefore, the differently color or hatched pixels of the bitmap represent different laser intensities, and it can be seen that, for the upper medial sidewall pixels, a solid black pixel represents a laser intensity of 0 (on a scale of scalar values from 0-255), i.e. there is no destruction of the surface to be engraved, whereas the line of grey or lightly hatched pixels 42 to the inside of the solid black line of pixels represents a laser intensity of perhaps half power, e.g. 126. The effect in the resulting engraving is that the medial sidewall of the engraving is stepped, or (in practice) there is some progressive grading of both the lateral and medial the sidewalls, and it can be seen from the figure that the grading of the medial sidewalls is different from the grading applied to the lateral sidewalls. As regards, the asymmetric nature of the bitmap, at least about the lateral axis, the skilled reader will appreciate that when two identical bitmaps 30 are arranged one above the other in adjacent but non-overlapping relationship (as can be seen in FIG. 3), only one solid black line of pixels is provided, and this is bounded on either side by a line of colored or hatched pixels. Accordingly, two so arranged depressions share one and the same medial sidewall, and this sidewall is progressively stepped upwardly from the base of the depression to the top of the sidewall and then similarly progressively stepped downwardly into the base of the adjacent depression. In terms of the laser engraving, such progressive stepping increases the structural strength of the sidewall and renders it more resistant to wear and fracture in the final engraving. The same principle, although to a lesser extent, applied to the lateral sidewalls, as it can be seen from FIG. 2 that for lateral sidewall 32, only relatively few pixels are of a solid black color, whereas the surrounding pixels are shown of a dark grey or in heavy hatching, meaning that only a relatively low energy laser beam is used in these regions so that the lateral sidewalls fall off or descend much more rapidly into the base of the depression.

A further point to note from FIG. 2 is that the lateral sidewall 34 is shown as a collection of X-hatched pixels because when two identical bitmaps are arranged laterally adjacent to one another and in medially offset fashion, as can be seen in FIG. 3, the lateral sidewall 34 of a first depression is actually formed by and shared with the lateral sidewall 32 of the adjacent depression.

Finally, it is to be noted that the overall lateral and medial sidewall thicknesses are the same despite their relatively progressively graduated structures. This has the effect of producing a highly, if not completely uniform pattern of depressions in the finished engraved article which, as previously mentioned, optimizes the overall liquid transfer characteristics of the engraved article.

Figure 4:
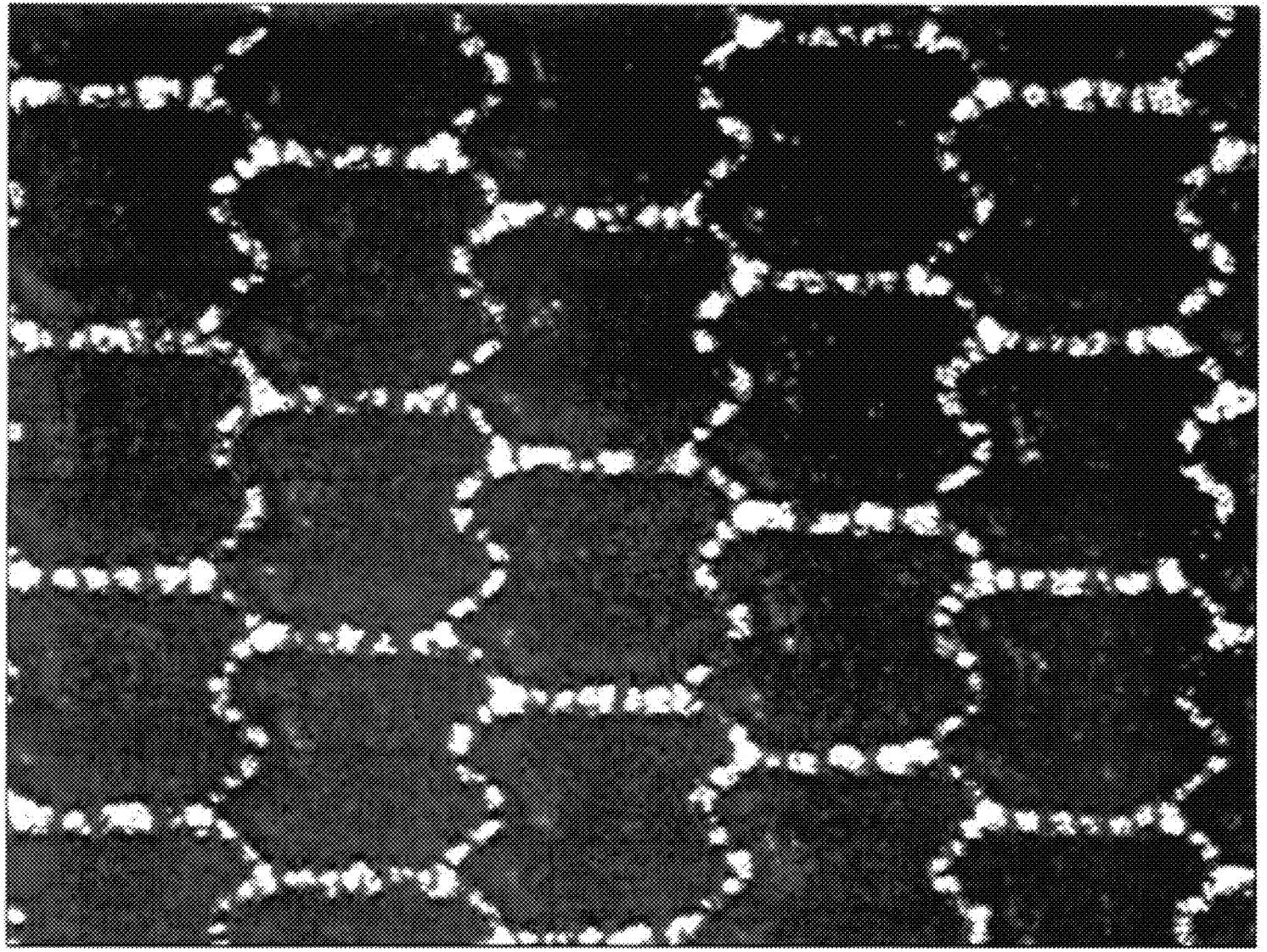
FIG. 4 shows an electron micrograph of a plan view of the surface, of an article engraved using the pattern of FIGS. 3 and 3A.

All of the above particular points of interest can be seen in FIG. 3, and more clearly in FIG. 4, both of which show patterns 40, 50 respectively including multiple bitmaps 32 arranged as they would be in a complete pattern template which would be created for a specific Anilox/Gravure roll or other article to be laser engraved under computer control.

Referring now to FIG. 4, an electron micrograph 60 is shown of a plan view of the surface of an article having been laser engraved according to patterns of the type depicted FIGS. 3, 4 at 40, 50. In FIG. 4, the outwardly and inwardly waisted shapes of all the depressions can be clearly seen and appear as in black portions representing the troughs or bases of the depressions, whereas the intervening shared lateral and medial sidewalls of any and all the depressions pictured appear as substantially continuous white lines meandering between the depressions. What is also to be noted from this Figure is that the white lines, representing shared intervening lateral and medial sidewalls also include some darker regions, indicating that the zeniths of the wall structures are not all of the same height. Although not specifically illustrated, this effect can be both unintentional, unavoidable and/or intentional. In some particular engravings, it can be highly desirable to provide one or more channels through the intervening and shared medial and/or lateral sidewalls between adjacent depressions to allow some, albeit a very limited amount, liquid to flow between adjacent depressions when in use, as this can provide a mechanism whereby any surplus liquid within one depression can be allowed to flow in restricted manner through the channels in its lateral and medial sidewalls into an adjacent depression, if for example one depression contains a surfeit of liquid and another adjacent depression contains a deficit. The provision of these channels, which are typically shallower than the depth of the depression itself, but can be of any depth required, possibly even equal to the depth of the depression itself, can promote uniformity of liquid distribution (and therefore again improve liquid transfer characteristics) over the operative engraved surface of the article, without necessarily affecting the capacity a small area of the engraved article to be tested for volumetric capacity, for example in the manner of the open structure engravings previously discussed.

As to whether the channels are provided intentionally or unintentionally, in very small depressions (where the sidewalls range from between 2 and 20 microns in length), it is often impossible to prevent the creation of these types of channels, because there is simply too much high energy laser activity proximate the sidewalls to prevent said sidewalls from being partially subjected to the lasers effect. For example, where a laser on full power is melting and subsequently incinerating ceramic material proximate a sidewall, it is sometimes inevitable that a portion of the sidewall will be melted and thus tend to flow to some degree before the laser moves away from it. It is these proximity effects which give rise to unintentional channel formation in the sidewalls. Of course, it is a relatively straightforward matter to provide intentional channel formations in the sidewalls—all that is required to be changed is the bitmap 32 shown in FIG. 2, and to change one or more pixels in the sidewalls 32, 34 (and/or the unreferenced medial sidewalls represented in that bitmap) so that the computer control recognizes that a particular area of a sidewall which would otherwise not have been subjected to laser treatment is so treated, and at a relatively low intensity so that the channel created is controlled relative to the overall depth of the depression.

Figure 5:
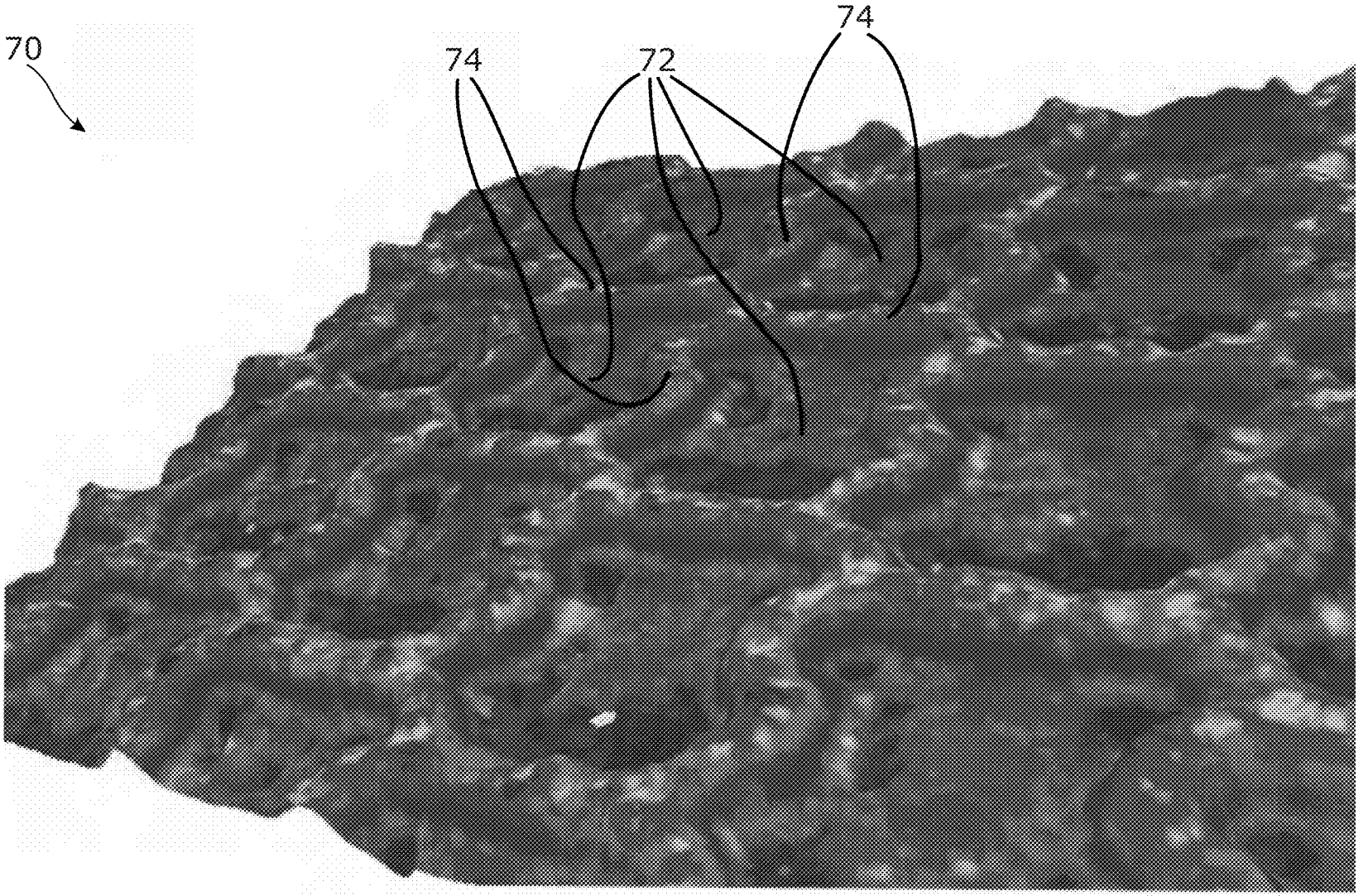
FIG. 5 shows an electron micrograph of a perspective view of the surface of an article engraved according to the pattern of FIGS. 3 and 3A.

Referring briefly to FIG. 5, a further electron micrograph 70 is shown illustrating in perspective the engraved surface of an article. Within this Figure, depressions 72 can be clearly seen as can the intervening, shared, substantially continuous lateral and medial sidewalls 74 of those depressions.

Figure 6:
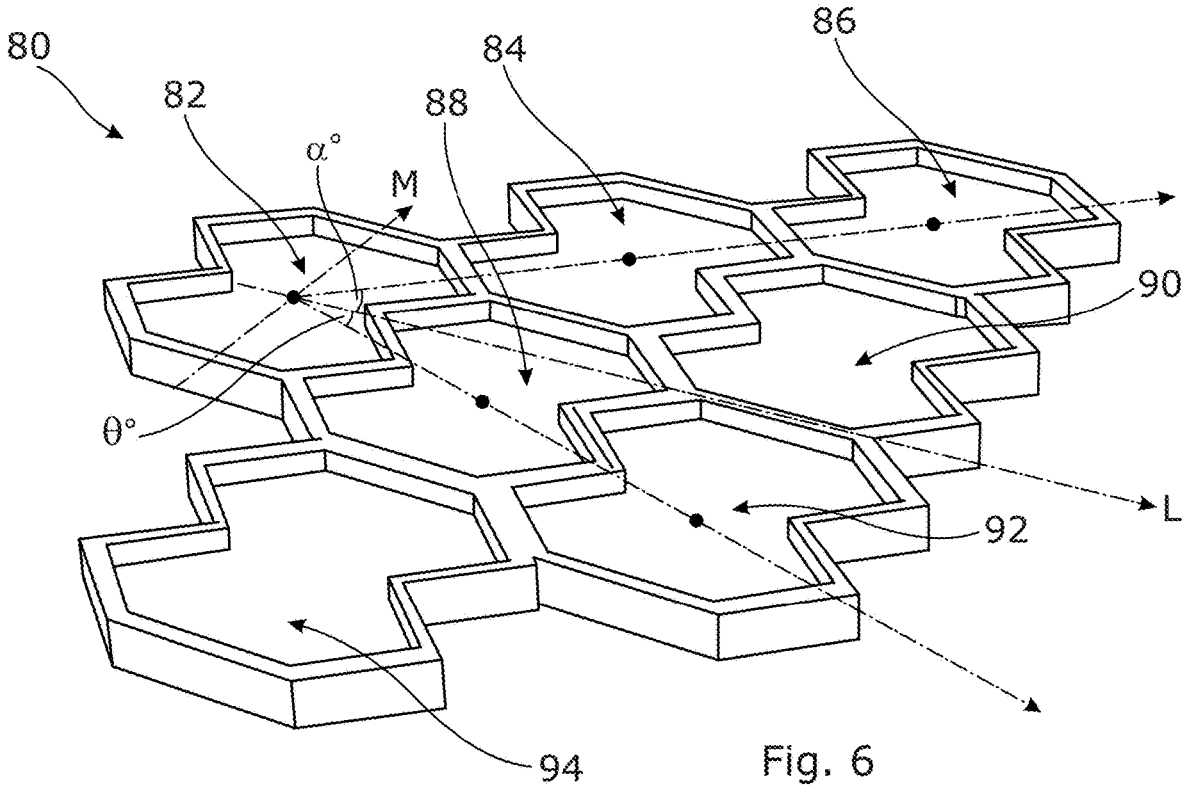
FIG. 6 shows a schematic perspective view of the manner in which the cells or depressions corresponding in shape to those shown in FIG. 1 may be arranged in interlocking relation after having been engraved in the surface of an article.

Referring now to FIG. 6, a schematic perspective illustration is shown of the manner in which depressions of the type shown at 2, 6, in FIG. 1 might be arranged within a pattern 80 in interlocking and adjacent relationship. In essence, FIG. 6 is a schematic theoretical depiction of the real-life engraving pictured in FIG. 5, and comprises multiple depressions 82, 84, 86, 88, 90, 92, 94, all of which share at least some portion of an intervening lateral or medial sidewall, as described above.

As this Figure only depicts a theoretical pattern, the sidewalls of the depressions are not progressively stepped or otherwise graduated, however, what is to be noted from the Figure is the relative offset departure (i.e. the extent to which they depart from the lateral axis L of depression 82) angles $\alpha$, $\Theta$ created between the midpoints of each upwardly offset depression 84, 86, (i.e. upwardly in the direction of medial axis M of depression 82) and each downwardly medially offset depression 88, 92. Depending on the orientation of the pattern 80, for example if the pattern is arranged so that the lateral axis L is aligned with the longitudinal axis of rotation of an Anilox or other engraved roll, then a is commonly known as the screen angle. What is important to note from the Figure is that α, Θ are clearly different, and furthermore, it is very easy to adjust these angles to suit particular applications or to overcome particular problems (such as moire effects) in any substrate printed or coating using a roll engraved with such a pattern. Indeed, the skilled reader will appreciate that the depression shape as herein described is inherently far more flexible in terms of its capacity for alteration than the known and common hexagonal and rectangular depression shapes currently.

Figure 7:
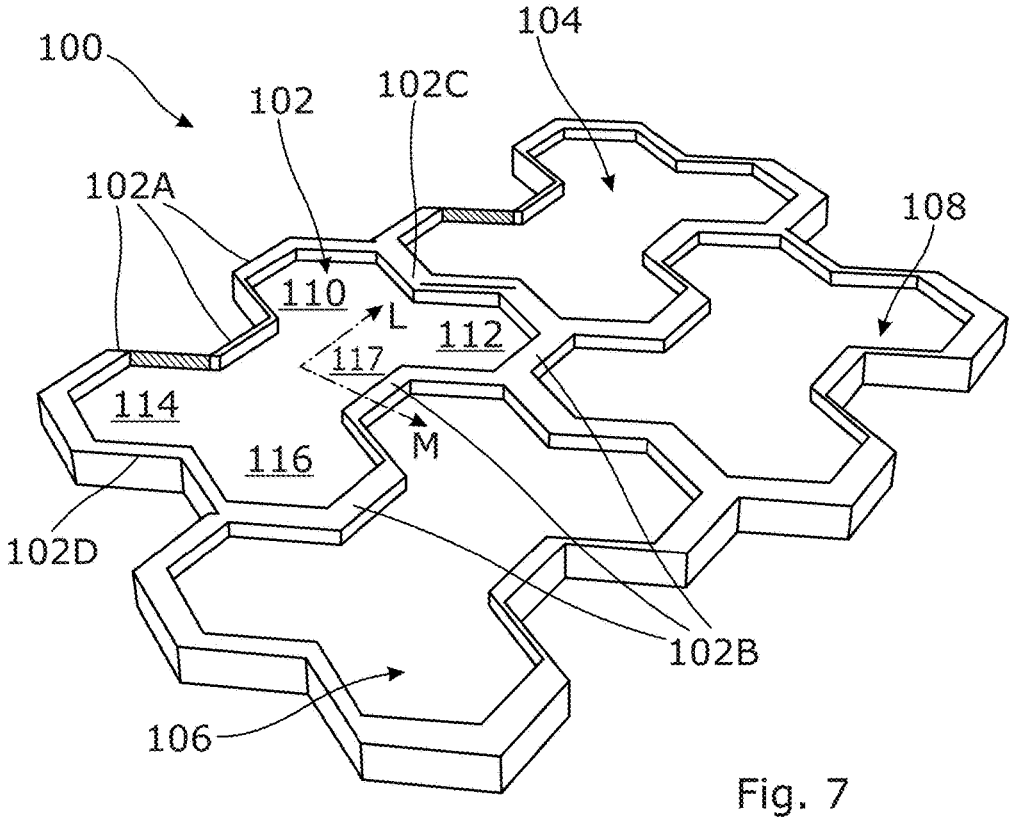
FIG. 7 shows a schematic perspective view of the manner in which the cells or depressions having a shape along both the lateral and medial sides of which are inwardly waisted, and how such cells or depressions may be arranged in interlocking relation after having been engraved in the surface of an article.

Referring to FIG. 7, a further schematic perspective illustration is shown of the manner in which depressions of a modified, more complex shape might be arranged within a pattern 100 in interlocking and adjacent relationship. As can be seen from this Figure, the pattern 100 comprises multiple depressions 102, 104, 106, 108, each of which again share at least some portion of an intervening lateral or medial sidewall. However, the lateral and medial sidewalls of each the depressions 102-108 is both inwardly and outwardly waisted along their lengths. Looking at depression 102 in particular, the depression is defined with a pair of lateral sidewalls 102A, 102B, the latter of which is shared with depression 106 and depression 108, and both of which include both outwardly and inwardly waisted portions (not referenced), and a pair of medial sidewalls 102C, 102D, the former of which is partially shared with depression 104, and which also both include both outwardly and inwardly waisted portions.

As can be seen from FIG. 7, the effect of providing waisted portions along both medial and lateral sidewalls is to essentially divide each depression into 4 separate lobes 110, 112, 114, 116, which are in fluid communication with one another through a generally central region 117 of the depression shape, any liquid present in any particular lobe of the depression shape seeking to move into an adjacent lobe must flow past a constriction created in either the lateral or medial sidewall defining the depression and formed by the inward waisting, in this case, provided at the approximate midpoint of that particular sidewall. It is also to be noted from this pattern of depressions that, by virtue of the more complex depression shape, not only are laterally adjacent depressions medially upwardly and downwardly offset (e.g. depressions 106, 108 are upwardly and downwardly offset relative to depression 102), but also medially adjacent depressions are laterally offset, forwardly in the case of depression illustrated 104, and rearwardly in the case of the other (not shown) depression which would lie laterally adjacent depression 104 along its leftmost side, as viewed in the Figure.

Figure 8:
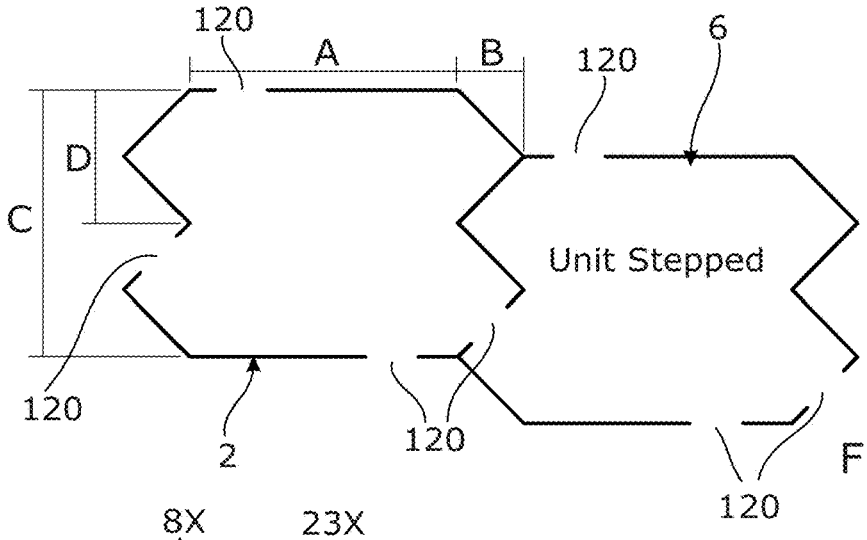
FIGS. 8, 9, 10, 11, and 12 show schematically various possible alternative configurations of the depression schematically illustrated in FIG. 1.

Referring finally to FIGS. 8, 9, 10, 11, and 12, in FIG. 8 there is shown schematically the two depressions 2, 6 of FIG. 1, but with walled peripheries which are intentionally discontinuous at multiple locations 120. For example, when the depressions are laser-engraved, it is also possible to intentionally laser engrave portions of the intervening walls which define and separate adjacent depressions so that there is some, albeit very limited, fluid communication between the depressions, namely through the gaps 120 provided in this manner through the walls.

Figure 9:
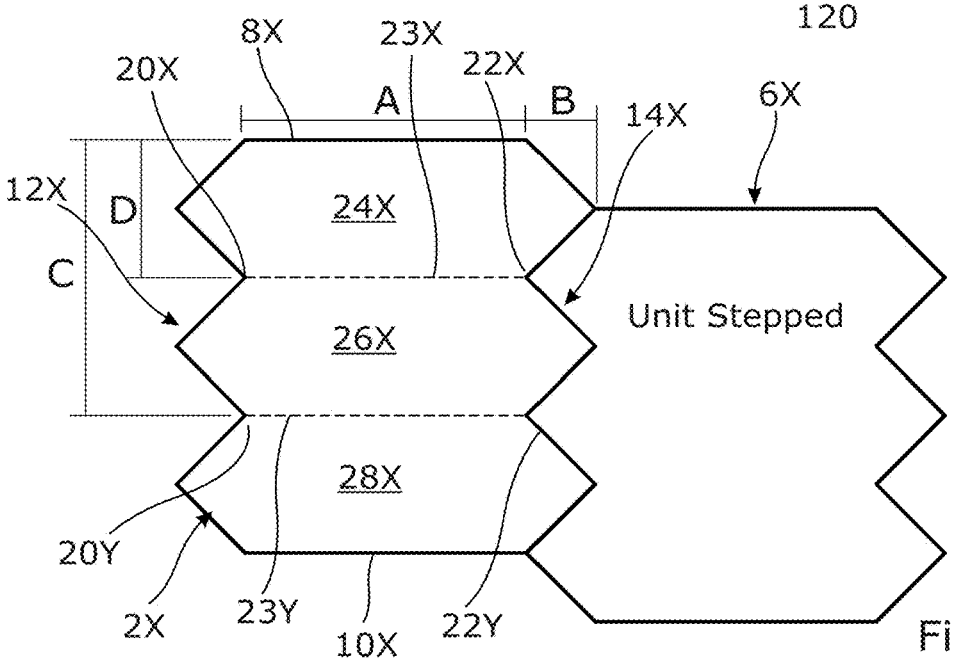

In FIG. 9, modified depressions 2X, 6X are shown in adjacent offset relationship, and it can be seen that for depressions 2X having lateral sidewalls 12X, 14X and medial sidewalls 8X, 10X, the contour of each of the sidewalls 12X, 14X is such that two constrictions 23X, 23Y are formed between sets of corresponding inwardly waisted regions 20X, 22X, and 20Y, 22Y of the sidewalls 12X, 14X, and therefore the depression is divided into three separate portions 24X, 26X, 28X. Such further division of the depression interior can again improve the overall liquid transfer characteristics of the article in which a pattern of such depressions is provided because depressions of this shape are capable of containing an even greater volume of print liquid and yet each of the depression portions is capable of performing as if it were only a (much narrower) single cell.

Figure 10:
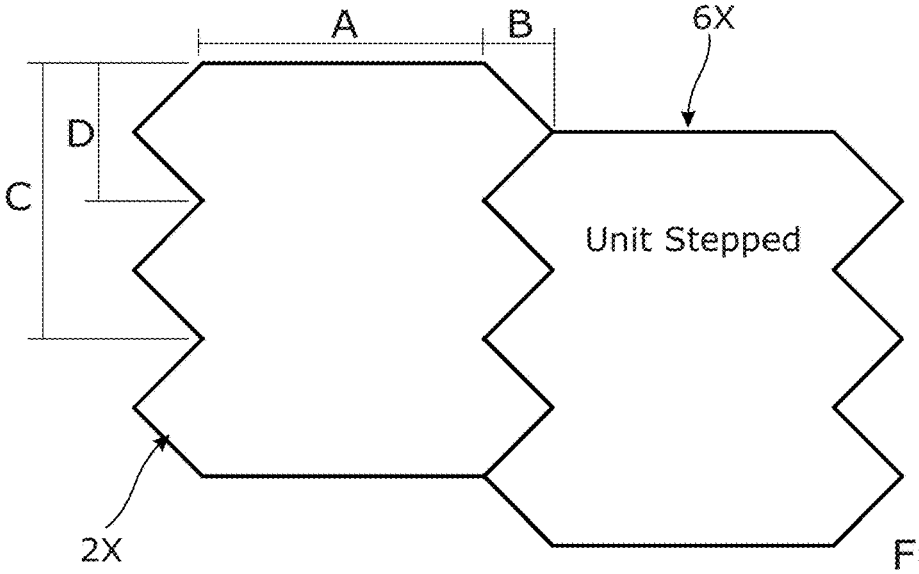

In FIG. 10, it is to be noted that, for the depressions 2X, 6X of FIG. 9, it is now possible to select an amount of medial offset, for example in FIG. 9, the adjacent depression 6X is offset medially downwardly from depression 2X by an amount equal to one sixth of the entire effective length of the lateral sidewall, whereas in FIG. 10, the adjacent depression 6X is offset medially downwardly from depression 2X by an amount equal to one half of the entire effective length of the lateral sidewall. Thus the modified depressions 2X, 6X are not only more volumetrically capacious, but they offer greater flexibility when it comes to arranging the depressions in a pattern.

Figure 11:
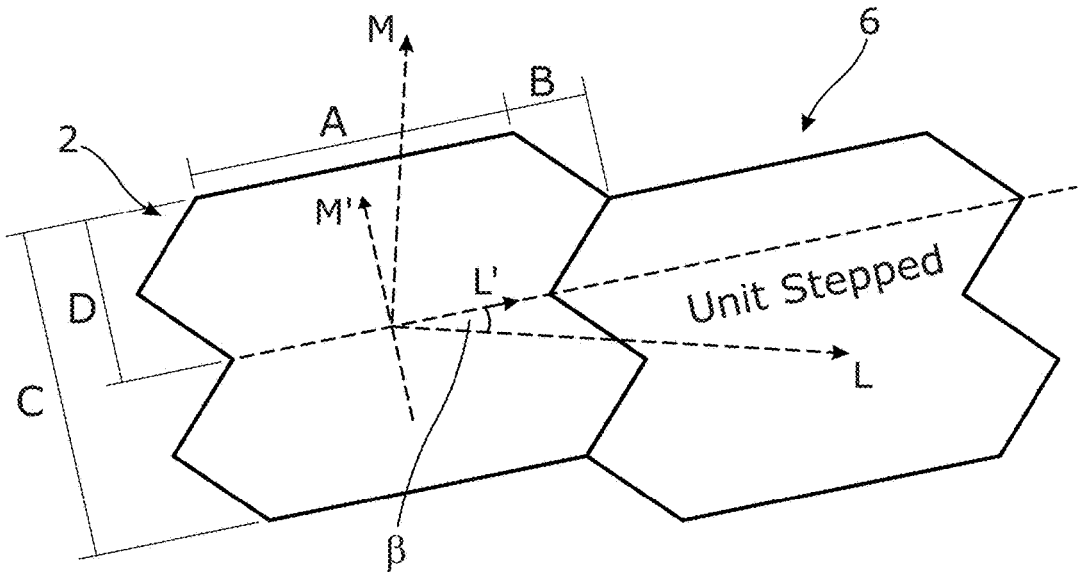

In FIG. 11, it can be seen that adjacent depressions 2, 6, have been rotated slightly so that the resulting pattern will be similarly inclined relative to, for example, longitudinal the axis of an Anilox/Gravure roll in whose surface such a pattern is provided. As can be seen for depression 2, the notional lateral and medial axes of which are shown at L', M', these axes are rotated by an amount β anti-clockwise from the corresponding notional axes L, M as were applicable for the depression 2 in FIG. 1.

Figure 12:
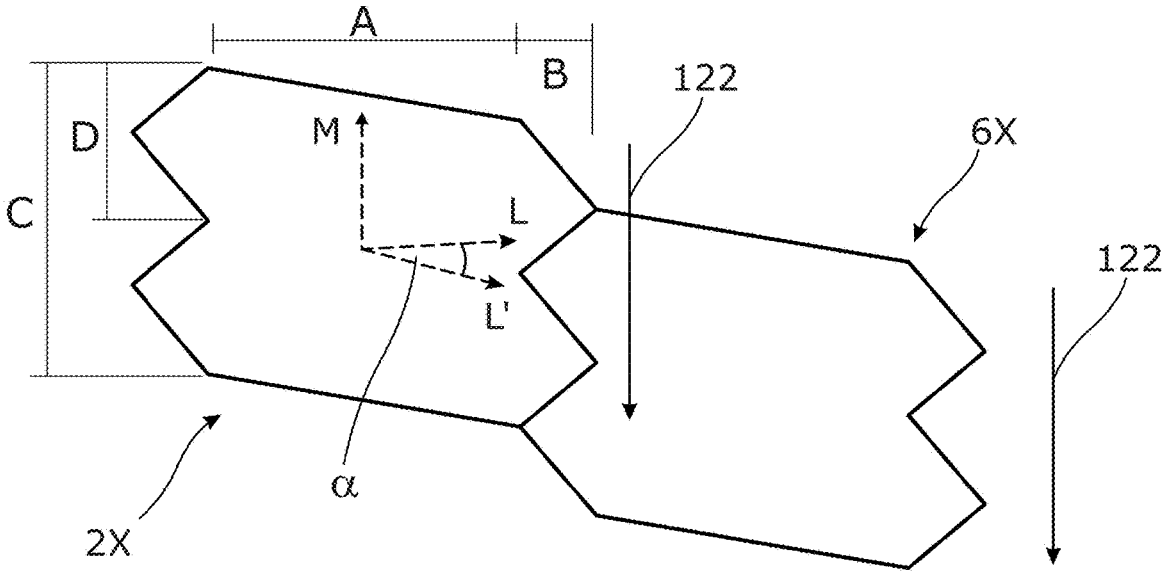

In an alternative arrangement shown in FIG. 12, it is possible for the depression shape to be sheared, either in a medial direction, upwardly or downwardly, or in a lateral direction to the left or right. In the Figure, the depressions 2X, 6X have both been the result of medially downward shear-type translations as indicated at arrow 122 in which one sidewall is sheared relative to the other. It is to be noted firstly that such shear type modification of the depression shape does not affect the capacity for the depressions to be arranged adjacent one another in a pattern, and secondly the original medial and lateral axes M, L are now transformed to axes M (as original) and L' (rotated downwardly from original axis L by an amount γ (gamma)). The shear-type modification of the shape may also result in the efficacy of the constriction within the depression being marginally reduced, and the depression volume also being reduced, but there may be specific application that could benefit from a pattern consisting entirely of these modified depressions. It is also to be noted that although the depression shapes in FIG. 12 is not, strictly speaking, symmetrical about its notional medial axis, the skilled reader will immediately understand that the shapes in FIG. 12 are largely symmetrical about the sheared (downwardly rotated) lateral axis L', and that about the original medial axis M, there is immediate symmetry about that axis if the shear is reversed. As such these additional examples should be considered as falling within the present invention.

The invention claimed is:

1. An article, at least one surface of which is operative in that it is provided with a plurality of microscopic discrete depressions which, in use, are repeatedly filled with a volume of liquid which is subsequently transferred as a result of contact with another article, said article being coated with a layer of a ceramic material providing the operative, liquid-receiving surface of the article, wherein the shape of the depressions is essentially closed;

said depressions being defined around their peripheries by a substantially or predominantly continuous wall structure comprised of the material of which the article surface is constituted;

said depressions being of a cross-sectional shape which is symmetrical about one or both of a lateral and a medial axis perpendicular thereto or is of a cross-sectional shape which can be sheared about its mid-point to give such a shape, those portions of the continuous wall structure defining the depression and being disposed on either side of such axes being medial and lateral sidewalls of the depression respectively;

said depressions being arranged adjacent one another to form a substantially uniform pattern of depressions over the operative surface of the article such that any two adjacent depressions share a portion of the wall structure which at least partially defines them;

wherein each of at least one of the pairs of lateral or medial sidewalls of a depression are contoured, the contour of one of the pair being generally the mirror image of the other so that together, said sidewalls define:

at least one constriction internally of the depression where each of the sidewalls in that pair is most proximate the other; and at least two adjacent depression portions on either side of said constriction and having a maximum lateral or medial dimension greater than the lateral or medial dimension of the constriction such that fluid flow from one portion to the other is partially restricted by said constriction.

2. An article according to claim 1, wherein the depression portions are one of similar and identical in shape.

3. An article according to claim 1, wherein the pattern is such that a first of any adjacent pair of depressions is at least partially offset from a second relative to one or both of the lateral or medial axis of the first depression so that not only are each of the depressions in that pair at least partially peripherally defined by a portion of the continuous wall structure which they share, but that also a third depression disposed adjacent both of said first and second depressions is at least partially peripherally defined by and further portions of the continuous wall structure shared with each of said first and second depressions.

4. An article according to claim 1, wherein the cross-sectional shape of the depression is symmetrical about both the lateral and medial axes, rotated or sheared as they may be.

5. An article according to claim 1, wherein the constriction is provided substantially at the mid-point of the lateral sidewalls and/or medial sidewalls.

6. An article according to claim 1, wherein one of the pair of lateral or medial sidewalls of each depression in the pattern is substantially linear or straight.

7. An article according to claim 1, wherein one of the pair of lateral or medial sidewalls of each depression in the pattern is parallel to one another.

8. An article according to claim 7, wherein one of the pair of lateral or medial sidewalls of each depression in the pattern is parallel to the respective medial or lateral axis defined for any one particular depression in the pattern.

9. An article according to claim 1, wherein the maximum lateral or medial dimension of a depression portion is equal to (1+x) times the length of one of the pair of respective medial or lateral sidewalls which partially defines it, where x is between about 0.25 and about 0.75.

10. An article according to claim 1, wherein the lateral dimension of the constriction, when orientated parallel to the lateral axis of a depression respectively, is equal to the length of one of the lateral sidewalls.

11. An article according to claim 1, wherein the sidewalls of the depression are contoured in such a manner so as to be complementary in that adjacent but laterally or medially offset depressions within the pattern interlock to at least some degree.

12. An article according to claim 1, wherein the effective width of the lateral sidewalls of any depression, measured along the respective lateral axis for that depression, is the same as the effective length of the medial sidewalls measured along the medial axis.

13. An article according to claim 12, wherein the depressions within the pattern are shallower than the thickness of the ceramic layer so as to be, together with the substantially continuous wall structure which defines them, entirely formed in said ceramic layer.

14. An article according to claim 1, wherein the article has a cross-sectional shape which is one of: cylindrical and annular.

15. An article according to claim 1, being one of an Anilox roll, an Anilox sleeve, a Gravure roll, or a Gravure sleeve.

16. A computer-controlled method of creating an article having a liquid-bearing operative surface in which is provided a laser-engraved pattern of substantially identical depressions uniformly arranged over said operative surface and defined by an intervening and substantially continuous wall structure, said method including the steps of:

providing, in said computer, a template definition of a single depression shape;

providing one or more geometric or other functional relationships between the dimensions of various aspects of that depression shape;

inputting one or more operating parameters and/or desired functional requirements of the resulting laser-engraved article, such including one or more of: wall thickness, line count, depression depth, overall volume requirement equating broadly to a desired coat weight, an indication of the print or coating liquid, its viscosity and/or its surface tension;

creating a pattern template based on all the above; and using the pattern template so created to control a laser so that the pattern is essentially engraved onto the operative surface of the article;

wherein;

the shape of the depressions is essentially closed;

said depressions being of a cross-sectional shape which is symmetrical about one or both of a lateral and a medial axis perpendicular thereto or is of a cross-sectional shape which can be sheared about its mid-point to give such a shape, those portions of the continuous wall structer defining the depression and being disposes on either side of such axes being the medial and lateral sidewalls of the depression respectively;

said depressions being arranged adjacent one another to form a substantially uniform pattern of depressions over the operative surface of the article such that any two adjacent depressions share a portion of the wall structure which at least partially defines them; and each of at least one of the pairs of lateral or medial sidewalls of a depression are contoured, the contour of one of the pair being generally the mirror image of the other so that together, said sidewalls define:

at least one constriction internally of the depression where each of the sidewalls in that pair is most proximate the other; and at least two adjacent depression portions on either side of said constriction and having a maximum lateral or medial dimension greater than the lateral or medial dimension of the constriction such the fluid flow from one portion to the other is partially restricted by said constriction.

17. The method of claim 16, wherein the depression portions are one of similar and identical in shape.

18. The method of claim 16, wherein the pattern is such that a first of any adjacent pair of depressions is at least partially offset from a second relative to one or both of the lateral or medial axis of the first depression so that not only are each of the depressions in that pair at least partially peripherally defined by a portion of the continuous wall structure which they share, but that also a third depression disposed adjacent both of said first and second depressions is at least partially peripherally defined by and further portions of the continuous wall structure shared with each of said first and second depressions.

19. The method of claim 16, wherein the cross-sectional shape of the depression is symmetrical about both the lateral and medial axes, rotated or sheared as they may be.

20. The method of claim 16, wherein the constriction is provided substantially at the mid-point of the lateral sidewalls and/or medial sidewalls.

21. The method of claim 16, wherein one of the pair of lateral or medial sidewalls of each depression in the pattern is substantially linear or straight.

22. The method of claim 16, wherein one of the pair of lateral or medial sidewalls of each depression in the pattern is parallel to one another.

23. The method of claim 22, wherein one of the pair of lateral or medial sidewalls of each depression in the pattern is parallel to the respective medial or lateral axis defined for any one particular depression in the pattern.

24. The method of claim 16, wherein the maximum lateral or medial dimension of a depression portion is equal to (1+x) times the length of one of the pair of respective medial or lateral sidewalls which partially defines it, where x is between about 0.25 and about 0.75.

25. The method of claim 16, wherein the lateral dimension of the constriction, when orientated parallel to the lateral axis of a depression, is equal to the length of one of the lateral sidewalls.

26. The method of claim 16, wherein the sidewalls of the depression are contoured in such a manner so as to be complementary in that adjacent but laterally or medially offset depressions within the pattern interlock to at least some degree.

27. The method of claim 16, wherein the width of the lateral sidewalls of any depression, measured along the respective lateral axis for that depression, is the same as the effective length of the medial sidewalls measured along the medial axis.

28. The method of claim 16, wherein the medial dimension of the constriction, when orientated parallel to the medial axis of a depression, is equal to the length of one of the medial sidewalls.

29. An article according to claim 1, wherein the medial dimension of the constriction, when orientated parallel to the medial axis of a depression, is equal to the length of one of the medial sidewalls.

30. An article according to claim 11, whereby the contoured lateral or medial sidewall of a first depression defines at least a lateral or medial projection portion and a lateral or medial recess portion which fit together with a lateral or medial recess portion and a lateral or medial projection portion respectively of a second immediately adjacent depression which shares said contoured lateral or medial sidewall of the first depression.

* * * * *